US005329905A

United States Patent [19]

Kawaguchi et al.

[11] Patent Number: 5,329,905

[45] Date of Patent: Jul. 19, 1994

[54] FUEL INJECTION TYPE INTERNAL COMBUSTION ENGINE

[75] Inventors: Yuji Kawaguchi; Makoto Kishida, both of Saitama, Japan

[73] Assignee: Honda Giken Kogyo Kabushiki Kaisha, Tokyo, Japan

[21] Appl. No.: 23,745

[22] Filed: Feb. 25, 1993

Related U.S. Application Data

[63] Continuation of Ser. No. 785,129, Oct. 30, 1991, abandoned.

[51] Int. Cl.[5] ..... F02M 51/00

[52] U.S. Cl. ..... 123/472; 123/432; 123/470

[58] Field of Search ..... 123/472, 470, 468, 469, 123/432, 531, 533; 239/533.12

[56] References Cited

U.S. PATENT DOCUMENTS

| | | | |
|---|---|---|---|
| 4,351,304 | 9/1982 | Schweizer . | |
| 4,434,766 | 3/1984 | Matsuoka et al. . | |
| 4,519,370 | 5/1985 | Iwata . | |
| 4,576,131 | 3/1986 | Sugiyama | 123/432 |
| 4,657,189 | 4/1987 | Iwata | 239/533.12 |
| 4,676,216 | 6/1987 | Ohsawa et al. . | |
| 4,699,323 | 10/1987 | Rush | 123/543 |
| 4,938,191 | 7/1990 | Oldani | 123/432 |
| 4,945,827 | 8/1990 | Ziegler | 123/472 |
| 4,982,716 | 1/1991 | Takeda | 123/531 |
| 5,018,501 | 5/1991 | Watanabe | 123/472 |
| 5,027,778 | 7/1991 | Nogi | 123/472 |
| 5,121,716 | 6/1992 | Takahashi et al. . | |

FOREIGN PATENT DOCUMENTS

| | | | |
|---|---|---|---|
| 0350885 | 1/1990 | European Pat. Off. | 123/472 |
| 2157127 | 12/1991 | Japan . | |

*Primary Examiner*—C. S. Miller
*Attorney, Agent, or Firm*—Lyon & Lyon

[57] ABSTRACT

A fuel injection type internal combustion engine includes a cylinder head which is provided with a pair of intake valve bores facing a combustion chamber, a single intake passage, and a pair of intake ports between which a partition wall is interposed and which connect the intake passage and the intake valve bores to each other, and a fuel injection valve with a fuel ejection port disposed to be directed from the single intake passage toward the intake valve bores. Air assist ejection ports are disposed near the fuel ejection port for finely atomizing the fuel and are disposed at opposite sides of the fuel ejection port on a plane substantially including the fuel ejection port and that end edge of the partition wall which is closer to the intake passage, so that the air assist injection directions intersect each other and the fuel jet. This ensures that the fuel jet is narrowed in width at a portion corresponding to the partition wall by air flows from opposite sides, so that the entire fuel jet is flattened. Therefore, the narrowing of the width of the fuel jet at the portion corresponding to the partition wall makes it possible to suppress the deposition of the fuel on the partition wall and to suppress the deposition of the fuel on inner surfaces of the intake ports in the vicinity of their connections with the partition wall.

5 Claims, 6 Drawing Sheets

FUEL INJECTION TYPE INTERNAL COMBUSTION ENGINE

This is a continuation-in-part of co-pending application Ser. No. 07/785,129 filed on Oct. 30, 1991 now abandoned.

BACKGROUND OF THE INVENTION

1. Field of the Invention

The field of the present invention is fuel injection type internal combustion engines comprising a cylinder head which is provided with a pair of intake valve bores facing a combustion chamber, a single intake passage for each combustion chamber, and a pair of intake ports between which a partition wall is interposed and which connect the intake passage and the intake valve bores to each other, and a fuel injection valve disposed to extend in a direction from the intake passage toward the intake valve bores and having a fuel ejection port, in the vicinity of which air assist ejection ports are disposed for finely atomizing the fuel.

2. Description of the Prior Art

Such a fuel injection type internal combustion engine has been conventionally known, for example, from U.S. Pat. No. 4,519,370. In this prior art fuel injection type internal combustion engine, an air flow is directed in a direction perpendicular to the direction of ejection of the fuel jet to collide against the fuel jet, thereby ejecting the finely atomized fuel from a single ejection port. However, the partition wall dividing the pair of intake ports independently connected to the pair of intake valve bores is located forward of the fuel injection valve and hence, the collision of the ejected flow of the fuel against the partition wall cannot be avoided. Therefore, an irregular flow of the fuel deposited on the partition wall into the combustion chamber causes a reduction in the control response of the operation of the engine. Particularly at a low temperature, the deposition of the fuel in the form of liquid film is increased and hence, it is difficult to provide the intended air-fuel ratio in a transitional operational condition, such as during speed-increasing, bringing about a considerable deterioration of the operation of the engine and the property of the exhaust gas.

SUMMARY OF THE INVENTION

Accordingly, it is an object of the present invention to provide a fuel injection type internal combustion engine wherein the deposition of the fuel on the partition wall can be avoided to the utmost, while providing a fine atomization of the fuel.

To achieve the above object, according to the present invention, there is provided a fuel injection type internal combustion engine comprising a cylinder head which is provided with a pair of intake valve bores facing the combustion chamber, a single intake passage, and a pair of intake ports between which a partition wall is interposed and which connect the intake passage and the intake valve bores to each other, and a fuel injection valve disposed to extend in the direction from the intake passage toward the intake valve bores and having a fuel ejection port, in the vicinity of which air assist ejection ports are disposed to provide a fine atomization of the fuel, wherein said air assist ejection ports are disposed at locations sandwiching said fuel ejection port from opposite sides to lie on a plane substantially including the fuel ejection port and that end edge of the partition wall which is closer to the intake passage and the assist air flowing from the air assist ejection ports intersects each other.

This ensures that air flows are ejected from the air assist ejection ports disposed to sandwich the fuel ejection port, toward a fuel jet ejected from the fuel ejection port, so that the fuel jet is narrowed in width at a portion corresponding to the partition wall by the air from the opposite sides, resulting in flattening the entire fuel jet. Therefore, it is possible to suppress the deposition of the fuel on the partition wall by narrowing the width of the fuel jet at the portion corresponding to the partition wall, and to suppress the deposition of the fuel to inner surfaces of the intake ports in the vicinity of their connection with the partition wall.

In addition to the above construction, an angle of intersection of the assist air flows from the air assist air ejection ports is set in a range such that the maximum value of an angle of spread of the fuel jet flattened by collision of the assist air flows against the fuel jet from the fuel ejection port becomes smaller than an angle formed by connection of the fuel ejection port with locations of side walls of the intake ports in the vicinity of the intake valve bores. This ensures that the collision of the fuel jet against the inner surfaces of the intake ports can be also avoided to the utmost.

The above and other objects, features and advantages of the invention will become apparent from a reading of the following description of the preferred embodiments, taken in conjunction with the accompanying drawings.

BRIEF DESCRIPTION OF THE DRAWINGS

The drawings illustrate a preferred embodiment of the present invention, wherein.

DESCRIPTION OF THE PREFERRED EMBODIMENTS

The present invention will now be described by way of a preferred embodiment in connection with the accompanying drawings.

Figure 1:
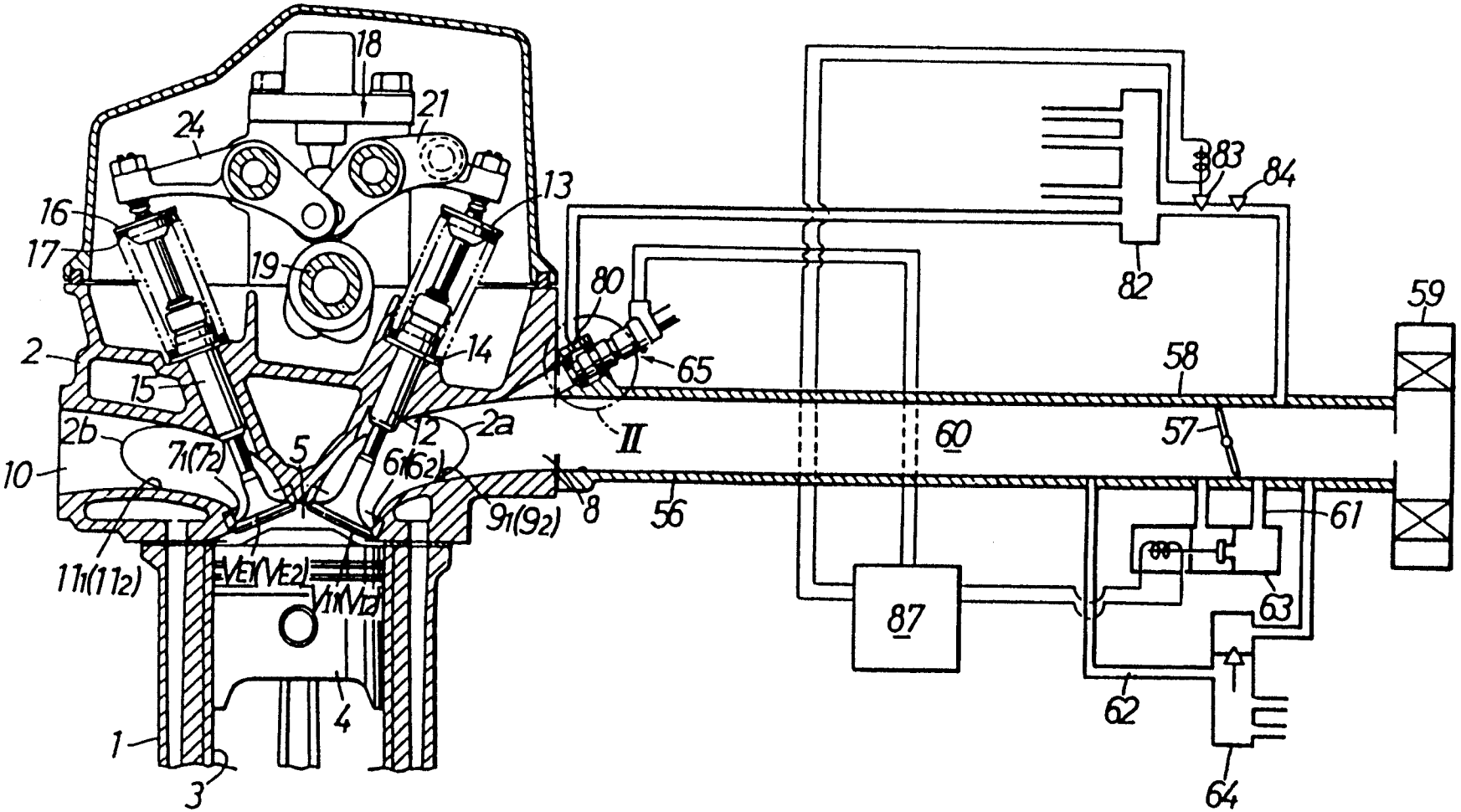
FIG. 1 is a sectional elevation view of an entire fuel injection type internal combustion engine according to the preferred embodiment.

Referring first to FIG. 1, a cylinder head 2 is coupled to the upper surface of a cylinder block 1 to comprise an engine body of an SOHC type multi-cylinder internal combustion engine. A piston 4 is slidably received in each of a plurality of cylinders 3 provided in the cylinder block 1, and a combustion chamber 5 is defined between each of the pistons 4 and the cylinder head 2.

A pair of intake valve bores $6_1$ and $6_2$ and a pair of exhaust valve bores $7_1$ and $7_2$ are provided in the cylinder head 2 and open into the ceiling surface of the combustion chamber 5. The intake valve bores $6_1$ and $6_2$ are connected to a single intake passage 8 opened into one side of the cylinder head 2 through intake ports $9_1$ and $9_2$ provided on opposite sides of a partition wall 2a. The exhaust valve bores $7_1$ and $7_2$ are connected to a single exhaust outlet 10 opened into the other side of the cylinder 2 through exhaust ports $11_1$ and $11_2$ provided on opposite sides of a partition wall 2b. A pair of intake valves $V_{I1}$ and $V_{I2}$ capable of independently opening and closing the intake valve bores $6_1$ and $6_2$ are slidably received in a pair of cylindrical guides 12 disposed in the cylinder head 2. Coiled valve springs 14 are interposed between the cylinder head 2 and retainers 13 fixed to the upper or stem ends of the intake valves $V_{I1}$ and $V_{I2}$ which project from the cylindrical guides 12. The springs 14 surround the corresponding intake valve $V_{I1}$ and $V_{I2}$ so that the intake valves $V_{I1}$ and $V_{I2}$ are biased upwardly, i.e., in their closing direction by the valve springs 14. Further, a pair of exhaust valves $V_{E1}$ and $V_{E2}$ capable of independently opening and closing the exhaust valve bores $7_1$ and $7_2$ are slidably received in a pair of cylindrical guides 15 disposed in the cylinder head 2. Coiled valve springs 17 are interposed between the cylinder head 2 and retainers 16 fixed to the upper ends of the exhaust valves $V_{E1}$ and $V_{E2}$ which project from the cylindrical guides 15. The springs 17 to surround the corresponding exhaust valve $V_{E1}$ and $V_{E2}$ so that the exhaust valves $V_{E1}$ and $V_{E2}$ are biased upwardly, i.e., in their closing direction by the valve springs 17.

A valve operating device 18 is connected to the intake valves $V_{I1}$ and $V_{I2}$ and the exhaust valves $V_{E1}$ and $V_{E2}$. The valve operating device 18 comprises a single cam shaft 19 operatively connected to a crankshaft at a reduction ratio of ½, a plurality of intake rocker arms 21 for converting the rotating movement of the cam shaft 19 into the opening and closing motions of the intake valves $V_{I1}$ and $V_{I2}$, and a plurality of exhaust rocker arms 24 for converting the rotating movement of the cam shaft 19 into the opening and closing motions of the exhaust valves $V_{E1}$ and $V_{E2}$.

An air cleaner 59 is connected to the intake passage 8 through an intake manifold 56 and a throttle body 58 having a throttle valve 57, and an intake passage 60 is provided in the intake manifold 56 and the throttle body 58 between the air cleaner 59 and the intake passage 8 in the cylinder head 2. A by-pass passage 61 and a first idle passage 62 are connected in parallel to the intake passage 60 around the throttle valve 57. An electromagnetic control valve 63 is provided in the by-pass passage 61, and a wax-operated valve 64 is provided in the first idle passage 62 and adapted to be operated in accordance with the temperature of the cooling water for the engine body.

Figure 2:
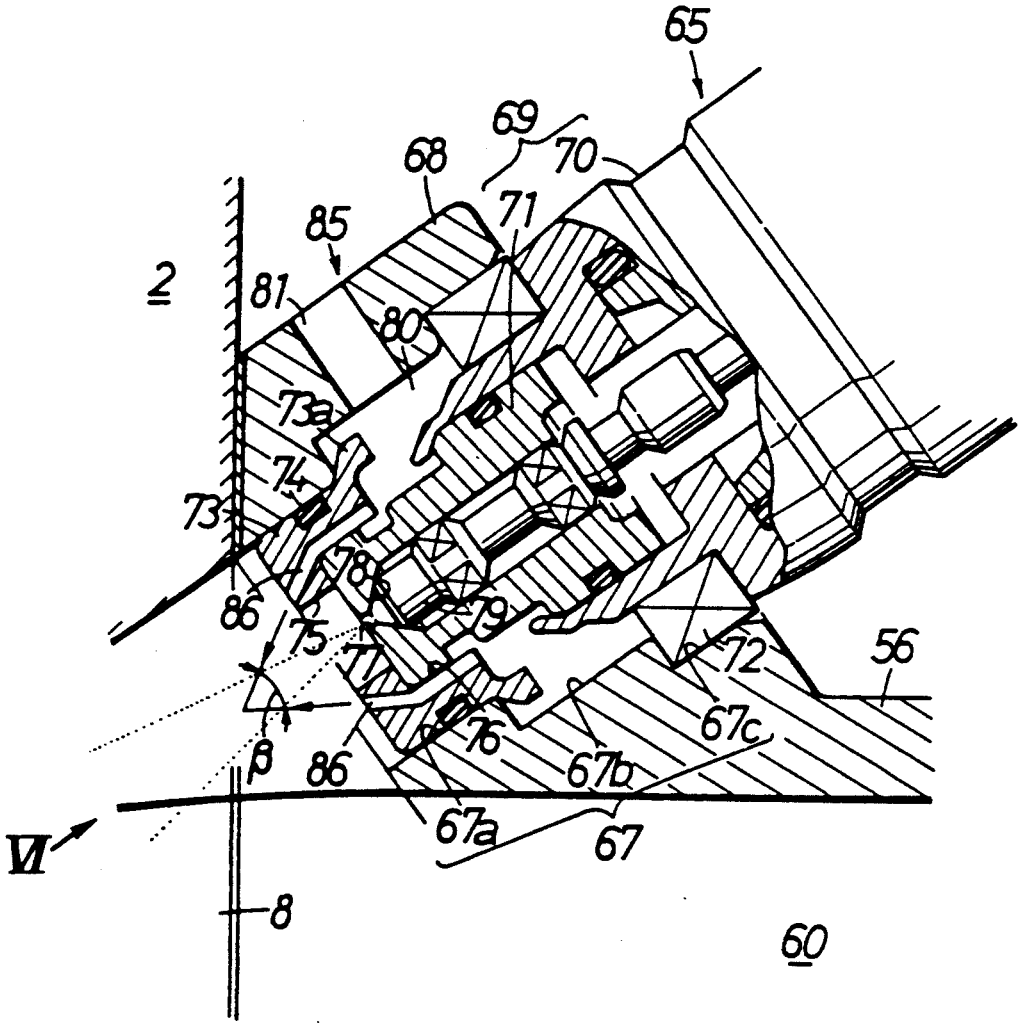
FIG. 2 is a view of the encircled portion indicated by II in FIG. 1 in an enlarged scale.
Figure 3:
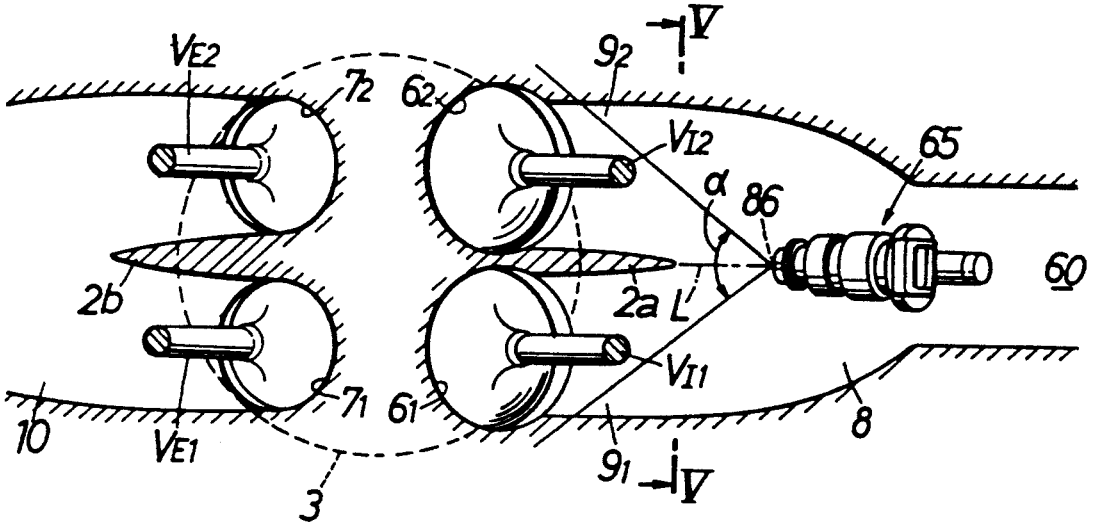
FIG. 3 is a sectional plan view illustrating the relative locations of the intake valve bores and a fuel injection valve.

Referring also to FIG. 2, a fuel injection valve 65 is mounted at the end of the intake manifold 56 which is closer to the cylinder head 2 to extend in a direction through the intake passage 8 toward the intake valve bores $6_1$ and $6_2$. More specifically, the end of the intake manifold 56 closer to the cylinder head 2 is provided with a mounting portion 68 including a mounting hole 67 having an axis inclined to extend in a direction through the intake passage 8 toward the intake valve bores $6_1$ and $6_2$, and the fuel injection valve 65 is mounted on the mounting portion 68 with its tip or leading end projecting into the mounting hole 67.

The mounting hole 67 is comprised of a small diameter hole portion 67a, a medium diameter hole portion 67b and a larger diameter hole portion 67c, which portions are coaxially connected to one another in sequence from an inner side of the mounting hole 67. The fuel injection valve 65 has a housing 69 which is comprised of a basically cylindrical valve housing 71 secured at its rear end to a drive portion housing 70 in which an electromagnetic drive portion (not shown) is contained. The housing 69 is mounted on the mounting portion 68 in such a manner that the valve housing 70 projects into the mounting hole 67 with a sealing member 72 interposed between the drive portion housing 70 and a step between the medium diameter hole portion 67b and the larger diameter hole portion 67c of the mounting hole 67.

A receiving member 73 is fitted in the smaller diameter hole portion 67a of the mounting hole 67 with a sealing member 74 interposed therebetween and is formed basically into a disk-like shape to have, at its rear end, an engagement collar 73a which engages a step between the smaller diameter hole portion 67a and the medium diameter hole portion 67b. A front through-hole 75 and a fitting hole 76 having a diameter larger than that of the through-hole 75 are centrally provided in the receiving member 73 in such a manner that they are coaxially connected to each other. A tip or leading end of the valve housing 71 in the fuel injection valve 65 is fitted into the fitting hole 76 in such a manner that it is received on a step between the through-hole 75 and the fitting hole 76.

A fuel ejection port 77 and a tapered valve seat 78 connected to the fuel ejection port 77 are coaxially provided in a central portion of the tip or leading end of the valve housing 71, and a valve member 79 capable of being seated on the valve seat 78 is axially movably contained within the valve housing 71. The valve member 79 is adapted to be driven by the electromagnetic drive portion contained in the drive portion housing 70 in an axial direction between a position in which it is seated on the valve seat 78 to close the fuel ejection port 77 and a position in which it is spaced apart from the valve seat 78 to open the fuel ejection port 77. When the valve member 79 has been moved away from the valve seat 78, fuel from a fuel supply source (not shown) is ejected from the fuel ejection port 77 forwardly, i.e., toward the intake passage 8.

With the fuel injection valve 65 mounted on the mounting portion 68, an annular air chamber 80 is defined between an inner surface of the mounting portion 68 and the housing 69, and a passage 81 is provided in the mounting portion 68 to lead to the air chamber 80. The passage 81 is connected to an air header 82 common to all the cylinders. The air header 82 is connected to the intake passage 60 at a point upstream of the throttle valve 57 through an electromagnetic air-amount control valve 83 and an idle adjusting screw 84.

A pair of air-assist ejection ports 86 and 86 are provided in the receiving member 73 on opposite sides of the fuel ejection port 77 of the fuel injection valve 65 to lead to the air chamber 80. The air-assist ejection ports 86 and 86 are intended to permit an air flow to collide against a fuel jet ejected from the fuel ejection port 77 to finely atomize the fuel and are provided in the receiving member 73 at opposite sides of the fuel ejection port 77 on a plane L substantially including the fuel ejection port 77 and an end edge, closer to the intake passage 8, of the partition wall 2a partitioning the pair of intake ports $9_1$ and $9_2$ leading from the intake passage 8, i.e., at locations above and below the fuel ejection port 77.

Figure 4:
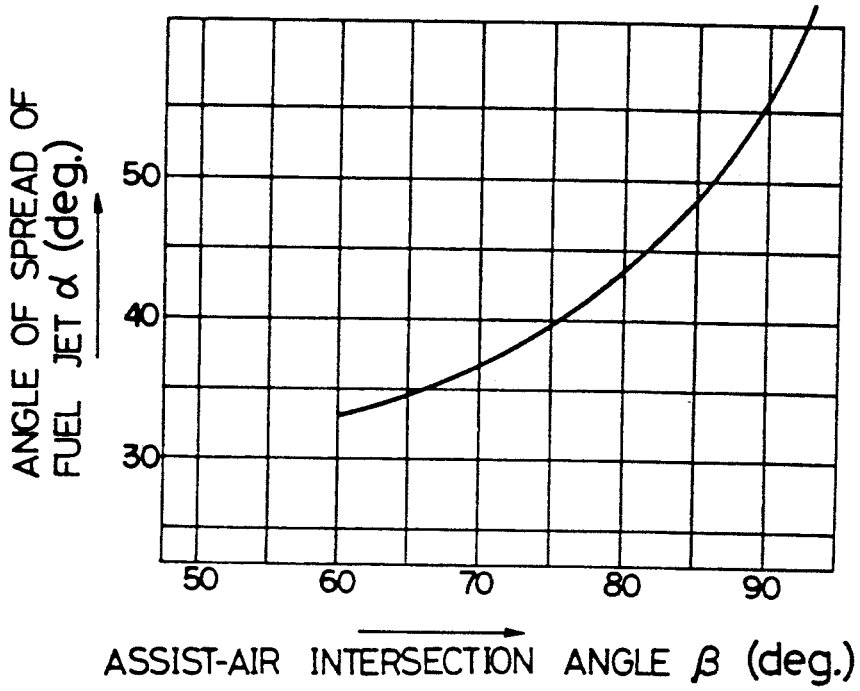
FIG. 4 is a graph illustrating the influence of the assist air intersection angle on the angle of spread of the fuel jet.

Moreover, the angle formed by the axes of the air-assist ejection ports 86 and 86, i.e., an assist-air intersection angle $\beta$ is set in a range such that the maximum value of an angle $\alpha$ of the spread of the fuel jet which has been flattened by the collision of the assist air against the fuel jet from the fuel ejection port 77 is smaller than an angle formed by a projection from the fuel ejection port 77 to the side walls of the intake ports $9_1$ and $9_2$ in the vicinity of the intake valve bores $6_1$ and $6_2$. For example, the angle $\alpha$ is about 50°. An example of tests carried out by the present inventors is shown in FIG. 4, wherein the angle $\alpha$ of spread of the fuel jet is gradually increased as the assist-air intersection angle $\beta$ is increased, and to restrain the spread angle $\alpha$ to about 50°, it is necessary to set the assist-air intersection angle $\beta$ at most at 90°. It should be noted that the assist-air intersection angle $\beta$ determining the angle $\alpha$ of spread of the fuel jet is required to be set in accordance with the shape of the intake ports $9_1$ and $9_2$. When the assist air is ejected by a differential pressure across the throttle valve 57 as in the present embodiment, such differential pressure is largest during idling of the engine in which the throttle valve 57 is in its closed state, so that the spread angle $\alpha$ is increased due to an increase in assist air force, whereas when the differential pressure is reduced, the spread angle $\alpha$ is decreased due to a decrease in assist air force. Therefore, the assist air intersection angle $\beta$ determining the maximum value of the spread angle $\alpha$ should be set during idling of the engine or in a condition in which the differential pressure is largest in a region in which an air-assisting is conducted, so that the spread angle $\alpha$ is largest.

Referring again to FIG. 1, the operations of the electromagnetic control valve 63, the fuel injection valve 65 and the electromagnetic air-amount control valve 83 are controlled by a control unit 87 comprising a computer.

Figure 5:
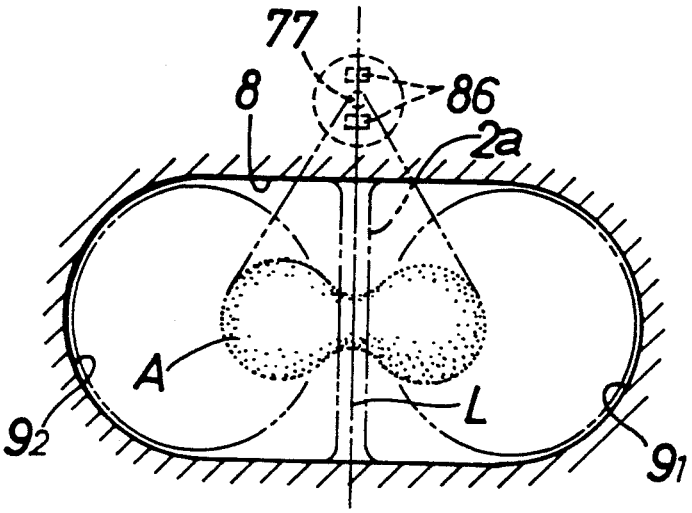
FIG. 5 is a sectional view taken along a line V—V in FIG. 3 for illustrating the cross-sectional shape of the fuel jet within the intake passage.
Figure 6:
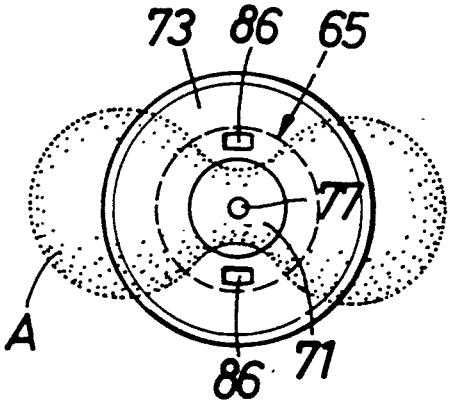
FIG. 6 is a view taken along an arrow VI in FIG. 2.

The operation of this embodiment will now be described. Air flows are ejected from the upper and lower air-assist ejection ports 86 and 86 toward a fuel jet ejected from the fuel ejection port 77 of the fuel injection valve 65, so that the fuel particles in the fuel jet are finely atomized by the collision of the air flows thereagainst. Moreover, the air-assist ejection ports 86 and 86 are provided in the receiving member 73 at the opposite sides of the fuel ejection port 77 on a diametrical line of the fuel ejection port 77 along the end edge of the partition wall 2a closer to the intake passage 8 and therefore, the collision of the air flows from the air-assist ejection ports 86 and 86 causes the fuel jet from the fuel ejection port 77 to be formed into a cocoon or figure "8" shape with a vertical width narrowed at a central portion corresponding to the partition wall 2a, as shown by A in FIGS. 5 and 6. This makes it possible to suppress the deposition of the fuel on the partition wall 2a and on the connected portions of the intake ports $9_1$ and $9_2$ with the partition wall 2a to the utmost.

It is desirable that the deposition of the fuel on the inner wall portions other than the partition wall 2a in the intake ports $9_1$ and $9_2$ also is avoided to the utmost. From this viewpoint, the assist air intersection angle $\beta$ is set, for example, at most at 90°, so that the maximum value of the angle $\alpha$ of spread of the fuel jet becomes smaller than an angle formed by connection of the fuel ejection port 77 with the side walls of the intake ports $9_1$ and $9_2$ in the vicinity of the intake valve bores $6_1$ and $6_2$. This ensures that the spread of the fuel jet can be suppressed, and the deposition of the fuel on the inner wall portions of the intake ports $9_1$ and $9_2$ other than the partition wall 2a can be suppressed to the utmost.

In this way, by forming the fuel jet from the fuel ejection port 77 into the cocoon shape by the collision of the air flows from the air assist ejection ports 86 and 86, it is possible to suppress the deposition of the fuel on the inner wall 2a, and by setting the assist air intersection angle $\beta$ within 90°, it is possible to suppress the deposition of the fuel on the inner wall portions of the intake ports $9_1$ and $9_2$ other than the partition wall 2a, thereby providing an improvement in the control response of the operation of the engine, as well as a good convergence to an intended air-fuel ratio in a transitional operational condition.

Figure 7:
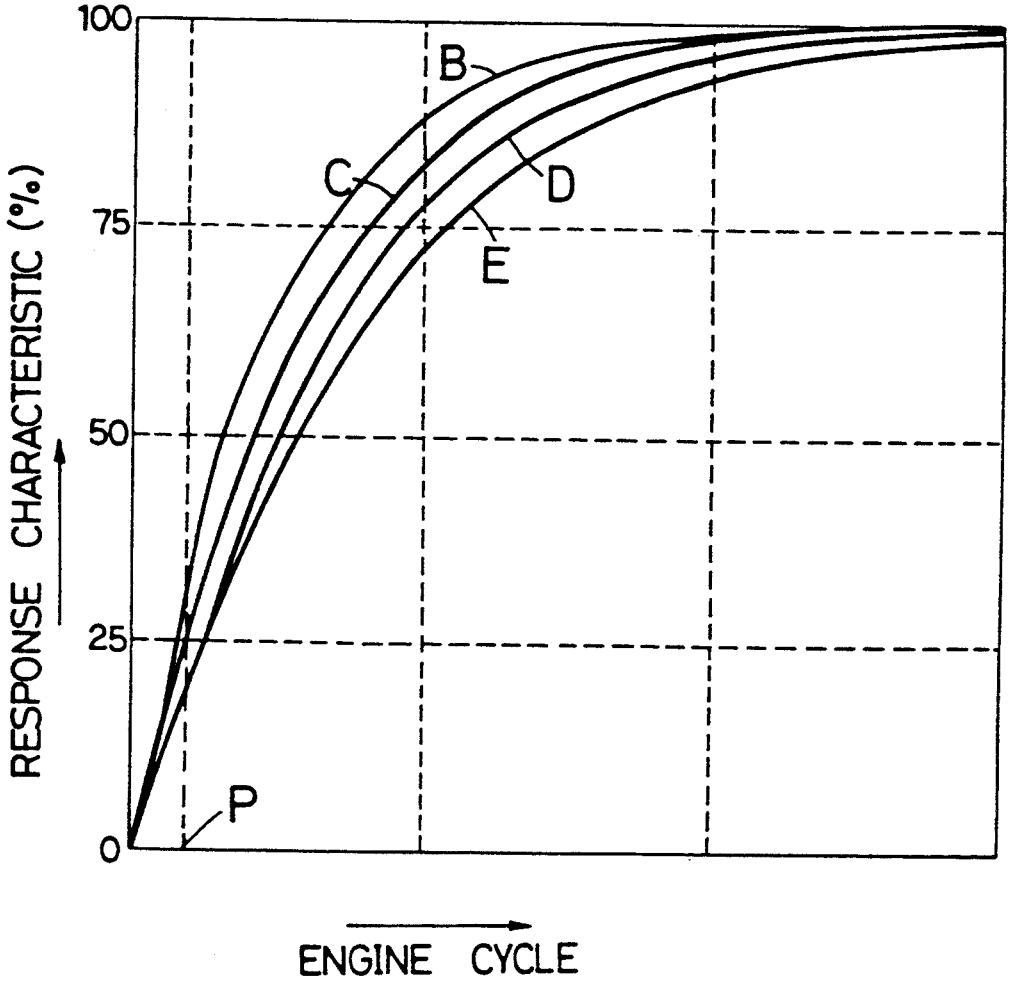
FIG. 7 is a graph illustrating the results of a test of an engine response characteristic.
Figure 8:
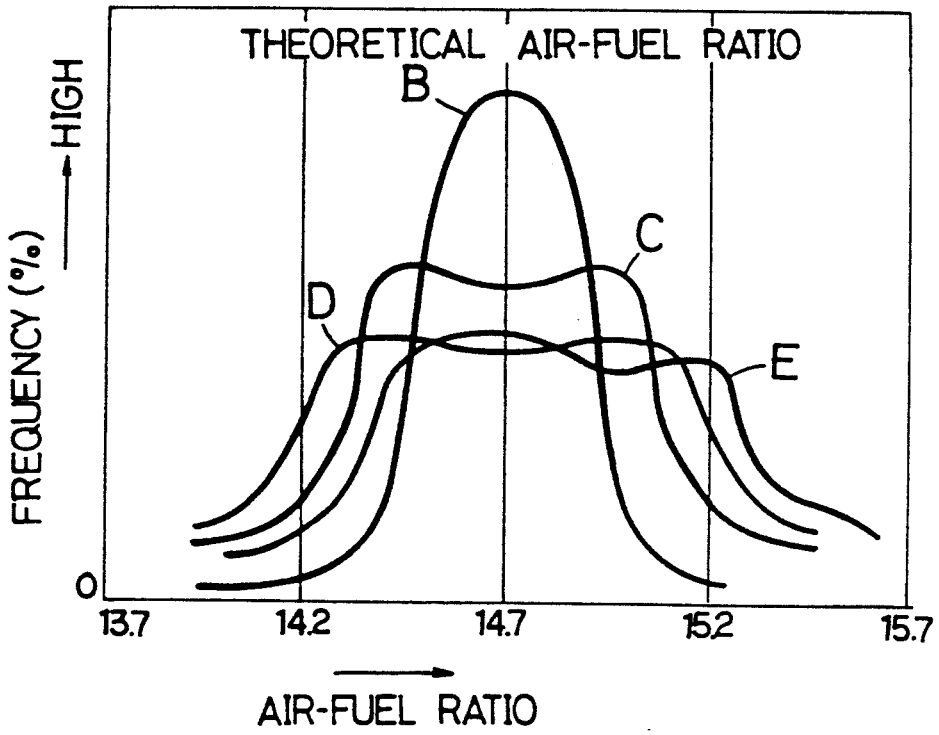
FIG. 8 is a graph illustrating the results of a test of the air-fuel ratio.

The results of a test carried out by the present inventors for the control response of the operation of the engine as well as for the convergence to the intended air-fuel ratio are as shown in FIGS. 7 and 8. The case where the fuel was ejected toward the intake valve bores $6_1$ and $6_2$ at the assist air intersection angle $\beta$ set within 90° is indicated by a curve B; the case where the fuel was ejected toward the intake valve bores $6_1$ and $6_2$ at the assist air intersection angle $\beta$ exceeding 90° is indicated by a curve C; the case where the fuel was ejected toward the intake valve bores $6_1$ and $6_2$ without air-assisting is indicated by a curve D; and the case where the fuel was ejected without being directed toward the intake valve bores $6_1$ and $6_2$ is indicated by a curve E. FIG. 7 shows the results of an experiment carried out at a low temperature indicating what extent of the engine cycle was required for obtaining the intended air-fuel ratio from a point P of variation in the amount of fuel ejection. FIG. 8 shows the results of an experiment carried out in a mode including an increase and decrease in speed for the convergence to the intended air-fuel ratio.

As apparent from FIGS. 7 and 8, it is possible to provide an improvement in engine response and to enhance the convergence to a theoretical air-fuel ratio, by disposing the pair of air assist ejection ports 86 and 86 at locations sandwiching the fuel ejection port 77 from opposite sides on the plane substantially including the end edge of the partition wall 2a closer to the intake passage 8 and the fuel ejection port 77 and moreover, by setting the assist air intersection angle $\beta$ so that the maximum value of the angle $\alpha$ of spread of the fuel jet becomes smaller than the angle formed by connecting the fuel ejection port 77 with the side walls of the intake ports $9_1$ and $9_2$ in the vicinity of the intake valve bores $6_1$ and $6_2$. The enhancement of the convergence to the theoretical air-fuel ratio makes it possible to keep the air-fuel ratio within a range permitting a high purifying efficiency of a ternary catalyst provided in an exhaust system, thereby providing a reduction in NOα in an exhaust gas. In addition, HC in the exhaust gas shows a tendency to increase due to an increase in probability for the fuel to enter directly into the combustion chamber 5 in the form of a liquid film by ejection thereof toward the intake passage 8, but it is possible according to this embodiment to reduce HC by introducing the assist air.

What is claimed is:

1. A fuel injection type internal combustion engine having a cylinder head which is provided with a pair of intake valve bores facing a combustion chamber, a single intake passage, and a pair of intake ports which are separated by a partition wall and which connect the intake passage to both the intake valve bores, and a fuel injection valve having a single fuel ejection port disposed to be directed from the intake passage toward the two intake valve bores, a pair of air assist ejection ports being disposed in the vicinity of the fuel ejection port for finely atomizing fuel from the fuel ejection port, said air assist ejection ports are disposed at opposite sides of said fuel ejection port to lie on a first plane that extends substantially perpendicular to a second plane on which the pair of intake ports lie, said fuel ejection port and an end edge of said partition wall which is closer to said intake passage being substantially included in said first plane, a pair of assist air flows from the pair of air assist ejection ports being directed to intersect each other at such a specific angle that intersection of the assist air flows controls the fuel ejected from the fuel ejection port so as to be atomized and change the shape of the pattern of fuel ejected from the fuel ejection port to flow into a cocoon shape substantially conforming to the shape of the pari of intake ports.

2. A fuel injection type internal combustion engine according to claim 1, wherein an angle of intersection of the assist air flowing from said air assist ejection ports at opposite sides of said fuel ejection port is set in a range such that the maximum value of an angle of spread of the fuel jet which is flattened in the second plane by a collision of the assist air flows against the fuel jet from the fuel ejection port becomes smaller than an angle formed by connecting said fuel ejection port with locations of side walls of said intake ports in the vicinity of said intake valve bores.

3. A fuel injection type internal combustion engine according to claim 2, wherein said angle of intersection of assist air flowing from said air assist ejection ports is set to be at most at 90°.

4. A fuel injection type internal combustion engine according to claim 1, wherein said single fuel ejection port has an opening toward the intake valve bores, further wherein said opening has a circular cross-section.

5. A fuel injection type internal combustion engine according to claim 1, wherein said single fuel injection port in said fuel injection valve is substantially circular that produces said pattern of fuel ejected as substantially circular, and said cocoon shape of fuel ejected has a narrowed width at a central portion corresponding to said partition wall.

* * * * *